US005642653A

United States Patent [19]

Hutchison

[11] Patent Number: 5,642,653

[45] Date of Patent: Jul. 1, 1997

[54] METHOD AND APPARATUS FOR PROVIDING DETENTS ON AN ELECTRONIC CONTROL HANDLE

[75] Inventor: Eric A. Hutchison, Peoria, Ill.

[73] Assignee: Caterpillar Inc., Peoria, Ill.

[21] Appl. No.: 547,049

[22] Filed: Oct. 23, 1995

[51] Int. Cl.[6] ..... F15B 13/044

[52] U.S. Cl. ..... 91/459

[58] Field of Search ..... 91/361, 459; 60/393

[56] References Cited

U.S. PATENT DOCUMENTS

| | | | |
|---|---|---|---|
| 3,789,739 | 2/1974 | Krehbiel et al. . | |
| 3,892,079 | 7/1975 | Hirano et al. . | |
| 4,015,729 | 4/1977 | Parquet et al. . | |
| 4,109,812 | 8/1978 | Adams et al. . | |
| 4,166,506 | 9/1979 | Tezuka et al. . | |
| 4,358,989 | 11/1982 | Tordenmalm . | |
| 4,422,474 | 12/1983 | Basrai et al. | 91/361 X |
| 4,552,503 | 11/1985 | Mouri et al. . | |
| 4,800,721 | 1/1989 | Cemenska et al. | 60/393 |
| 4,844,685 | 7/1989 | Sagaser . | |
| 4,893,981 | 1/1990 | Yoshinada et al. . | |
| 5,054,599 | 10/1991 | Marcott | 91/361 X |
| 5,102,102 | 4/1992 | Hidaka et al. | 91/361 X |
| 5,189,940 | 3/1993 | Hosseini et al. | 91/361 |
| 5,195,864 | 3/1993 | Drake et al. . | |
| 5,201,177 | 4/1993 | Kim | 91/459 X |
| 5,333,533 | 8/1994 | Hosseini | 91/361 |
| 5,537,818 | 7/1996 | Hosseini et al. | 91/459 X |

FOREIGN PATENT DOCUMENTS 2225127 5/1990 United Kingdom .

*Primary Examiner*—F. Daniel Lopez
*Attorney, Agent, or Firm*—James R. Yee

[57] ABSTRACT

An apparatus and method for providing a detent function on a hydraulic system. The hydraulic system includes a hydraulic implement movable between first and second implement positions. The apparatus and method receives a control input signal generated by an electronic control handle in response to operator input, monitors the control input signal, and actives a detent function if the control input signal follows a preset pattern. The preset pattern includes moving the handle to a detent area, between first and second positions, and then back to neutral, within a given time period. There is also a force feedback to the handle, opposing operator movement; which is proportional to the distance moved from neutral, and which has different attributes within and outside the detect area.

16 Claims, 3 Drawing Sheets

108
107
ELECTRONIC CONTROL MEANS
MONITORING MEANS
116
DETENT FUNCTION PROVIDING MEANS
118
110
POSITION SENSING MEANS
114
HYDRAULIC CONTROL MEANS
112
HYDRAULIC IMPLEMENT
106
104
102

LEVER FORCE
204
206
208
VALVE DISPLACEMENT
VALVE DISPLACEMENT
202
NEUTRAL
FULL LEVER TRAVEL
LEVER POSITION
FULL REQUEST

BEGIN
402
IMPLEMENT POSITION ≥ KICKOUT POSITION?
YES
NO
404
DETENT FLAG = OFF
406
CONTROL INPUT SIGNAL IN DETENT REQUEST POSITION?
NO
YES
408
DETENT FLAG = ON, RESET TIMER
410
DETENT FLAG = ON?
NO
YES
412
UPDATE TIMER
NO
TIMER EXPIRED?
414
YES
416
CONTROL INPUT SIGNAL = NEUTRAL?
NO
YES
DETENT FLAG = OFF
420
418
SET VALVE ACTUATOR SIGNAL TO FULL DISPLACEMENT
RETURN

METHOD AND APPARATUS FOR PROVIDING DETENTS ON AN ELECTRONIC CONTROL HANDLE

TECHNICAL FIELD

This invention relates generally to electronic control handles and, more particularly, to an apparatus and method for providing detents on an electronic control handle.

BACKGROUND ART

Earthmoving machines traditionally have used hydraulic systems to power implements. The implement is controlled by an operator via one or more hydraulic implement control handles. The hydraulic implement control handles are directly coupled to one or more valves to effectuate operation of the hydraulic system. Each handle includes one or more mechanical or electromechanical detents which act to lock the control handle in a full displacement position until a desired position is reached.

With the increasing use of microprocessor controlled hydraulic systems, the hydraulic implement control handles may be replaced by electronic control handles or joysticks. The joysticks, combined with the microprocessor controlled system, provide a less expensive, simpler, more reliable, and more flexible system capable of advanced operator features and automation.

The detent function remains desirable, but adding the mechanical hardware to the electronic handle or joystick is costly and increases the complexity of the design.

The present invention is aimed at solving one or more of the problems presented above.

DISCLOSURE OF THE INVENTION

In one aspect of the present invention, an apparatus for providing a detent function on a hydraulic system is provided. The hydraulic system includes a hydraulic implement movable between first and second implement positions. The apparatus includes an electronic control handle or joystick, operable by an operator between first and second control positions, for producing a control input signal indicative of desired movement of the hydraulic implement between the first and second implement positions. A controller coupled to the electronic joystick, receives the control input signal and responsibly actuates the hydraulic implement. The controller monitors the control input signal and responsibly actuates an active detent function if the control input signal follows a preset sequence.

In a second aspect of the present invention, a method for providing a detent function on a hydraulic system is provided. The hydraulic system includes a hydraulic implement movable between first and second implement positions. The method includes the steps of receiving a control input signal generated by an electronic joystick in response to operator input, monitoring the control input signal, and activating a detent function if the control input signal follows a preset sequence.

BEST MODE FOR CARRYING OUT THE INVENTION

Figure 1:
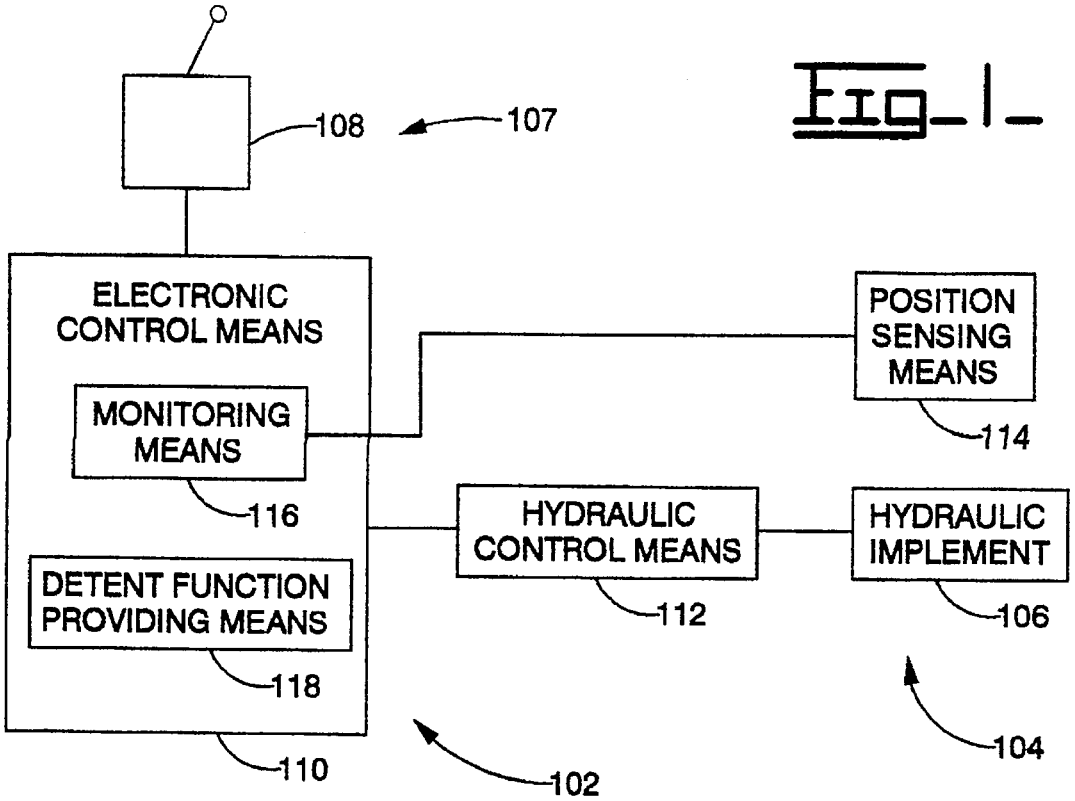
FIG. 1 is a block diagram of an apparatus for providing detents on an electronic control handle, according to an embodiment of the present invention.

With reference to FIG. 1, the present invention or apparatus 102 is adapted to provide a detent function on a hydraulic system 104. The hydraulic system 104 includes a hydraulic implement 106 movable between first and second implement positions. The hydraulic implement 106 is generally located on a work machine (not shown).

For example, the work machine may be a bucket loader. The hydraulic system 104 of the bucket loader includes a bucket connected to a linkage arrangement which is connected to the machine. One or more hydraulic cylinders provide movement of the bucket and linkage. Other machines and hydraulic implement arrangements may be substituted without departing from the spirit of the invention.

The hydraulic implement is movable between first and second implement positions. For example, on the bucket loader, the hydraulic implement 106 is movable between a maximum raised position and a minimum lowered position.

The control input means 107, which is operable by an operator between first and second control positions, produces a control input signal indicative of desired movement of the hydraulic implement between the first and second implement positions. In the preferred embodiment, the control input means 107 includes an electronic control handle or joystick 108.

An electronic control means 110 is coupled to the controlled input means and receives the control input signal. In the preferred embodiment the electronic control 110 includes a microprocessor based Electronic Control Module (ECM). In accordance with a control program, as discussed below, the electronic control means 110 produces a valve actuation signal as a function of the control input signal.

A hydraulic control means 112 is coupled between the electronic control means 110 and the hydraulic implement 106. The hydraulic control means 112 receives the valve actuation signal and responsively provides hydraulic fluid flow to the hydraulic implement. The hydraulic control means 112 includes one or more hydraulic control valves. The hydraulic control means 112 also includes at least one hydraulic cylinder for direct actuation of the hydraulic implement 106.

The electronic control means 110 includes a monitoring means 116 and a detent function providing means 118, both embodied in software. The monitoring means 116 monitors the control input signal and responsively produces an active detent signal if the control input signal follows a preset pattern. The detent function providing means 118 receives the active detent signal and automatically actuates the hydraulic control means 112 in response to receiving the active detent signal. The operation of the monitoring means 116 and detent function providing means 118 is discussed more fully below.

Figure 2:
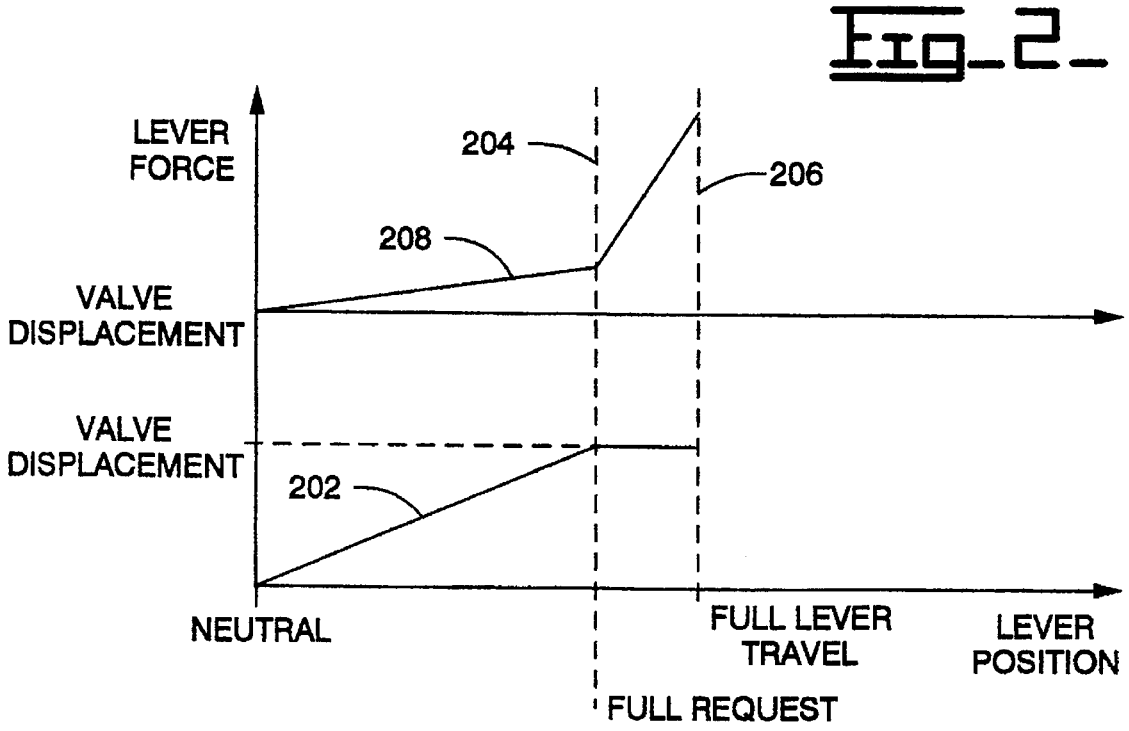
FIG. 2 is a graph illustrating handle force and valve displacement versus lever position.

With reference to FIG. 2, operation of the apparatus 102 with respect to control level position and valve displacement is discussed. For example, in the bucket loader, the apparatus 102 includes two electronic control handles. The first electronic control handle controls actuation of the boom linkage. The second electronic control handle controls actuation of the bucket. Each control handle is movable in two directions along an axis from a neutral position. For example, movement of the first control handle in one direction from a neutral position raises the boom's linkage. Movement in the opposite direction lowers the boom linkage. A detent function may be provided in each direction. However, for discussion purposes, lever movement and a detent position for only one direction is discussed.

The detent function provided by the apparatus 102 provides a semiautomatic mode whereby the hydraulic implement 106 is automatically positioned into a preset, desired position. The desired position may be programmable. Returning to FIG. 2, in the lower graph line 202 represents the corresponding valve displacement for the actuated electronic control handle 108. Between the lever positions neutral and full request, valve displacement is predetermined. In the preferred embodiment, valve displacement as a function of lever position between neutral and full request is determined via a lookup table.

If the operator moves the lever position past the full request position, the lever is now in a detent request area. If the operator moves the joystick in a preset pattern, as described below, the detent function is activated and valve displacement is set to full displacement.

A position sensing means 114 senses the position of the hydraulic implement 106 and produces a hydraulic implement position signal.

Valve displacement is set to full displacement until either the hydraulic implement 106 reaches the desired position or the operator cancels the detent function as described below.

A force feedback means 120 provides feedback to the operator through the control handle 108. During movement of the control handle 108 by the operator, the force feedback means 120 applies a force opposite to the movement by the operator. The lever force or the force applied to the lever is proportional to the lever position as shown in FIG. 2. In the preferred embodiment, the force applied to the lever between the neutral and full request position is linear with a preset slope. Between the full request and the full lever travel positions, i.e. in the detent request area, the lever force is increased at a much greater slope.

The force feedback means 120 may include a spring or series of springs to apply the force. Alternately, a torque motor may be used to apply the force. One such system is disclosed in U.S. Pat. No. 4,800,721 issued to Richard A. Cemenska et al on Jan. 31, 1989 which is herein incorporated by reference. Other means of applying a force to the lever may be used.

Figure 3:
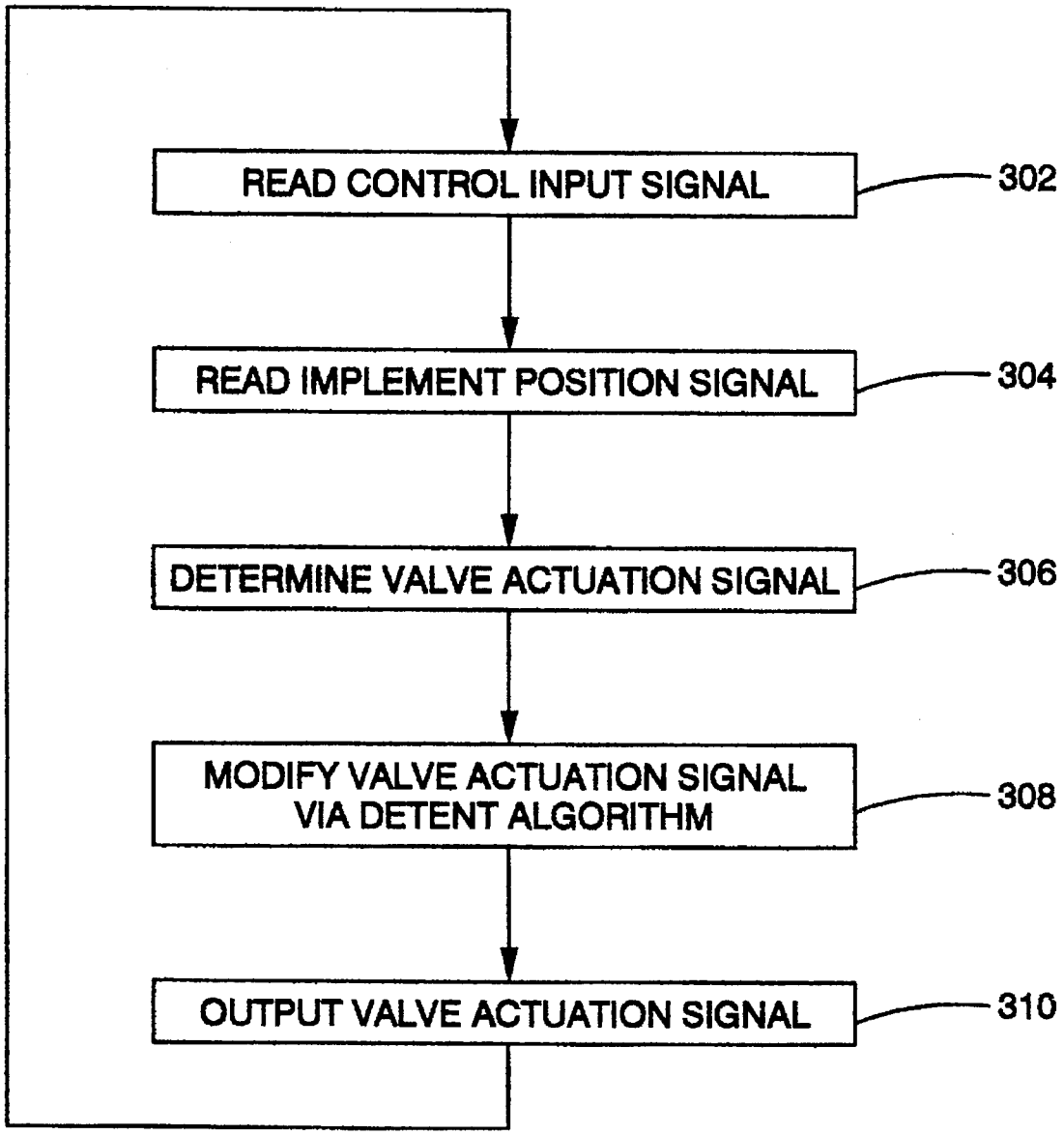
FIG. 3 is a flow diagram of a main control algorithm illustrating operation of the apparatus of FIG. 1, according to an embodiment of the present invention;and, FIG. 4 is a flow diagram illustrating a detent algorithm of the flow diagram of FIG. 3 according to an embodiment of the present invention.

With reference to FIG. 3, the electronic control means 110 includes a main control routine 300. Generally, the electronic control means 110 performs the following steps: receives the control input signal generated by the control handle in response to operator input; monitors the control input signal and activates the detent function if the control input signal follows a preset pattern.

The main control routine 300, in a first control block 302 reads the control input signal. In a second control block 304, the implement position signal is read. In a third control block 306, the valve actuation signal is preferably determined as a function of the control input signal. As discussed above the valve actuation is determined via a lookup table. In a fourth control block 308, the valve actuation signal is modified via a detent algorithm as discussed below. In a fifth control block 310 the valve actuation signal is output to the hydraulic control means 112. Control then returns to the first control block 302.

Figure 4:
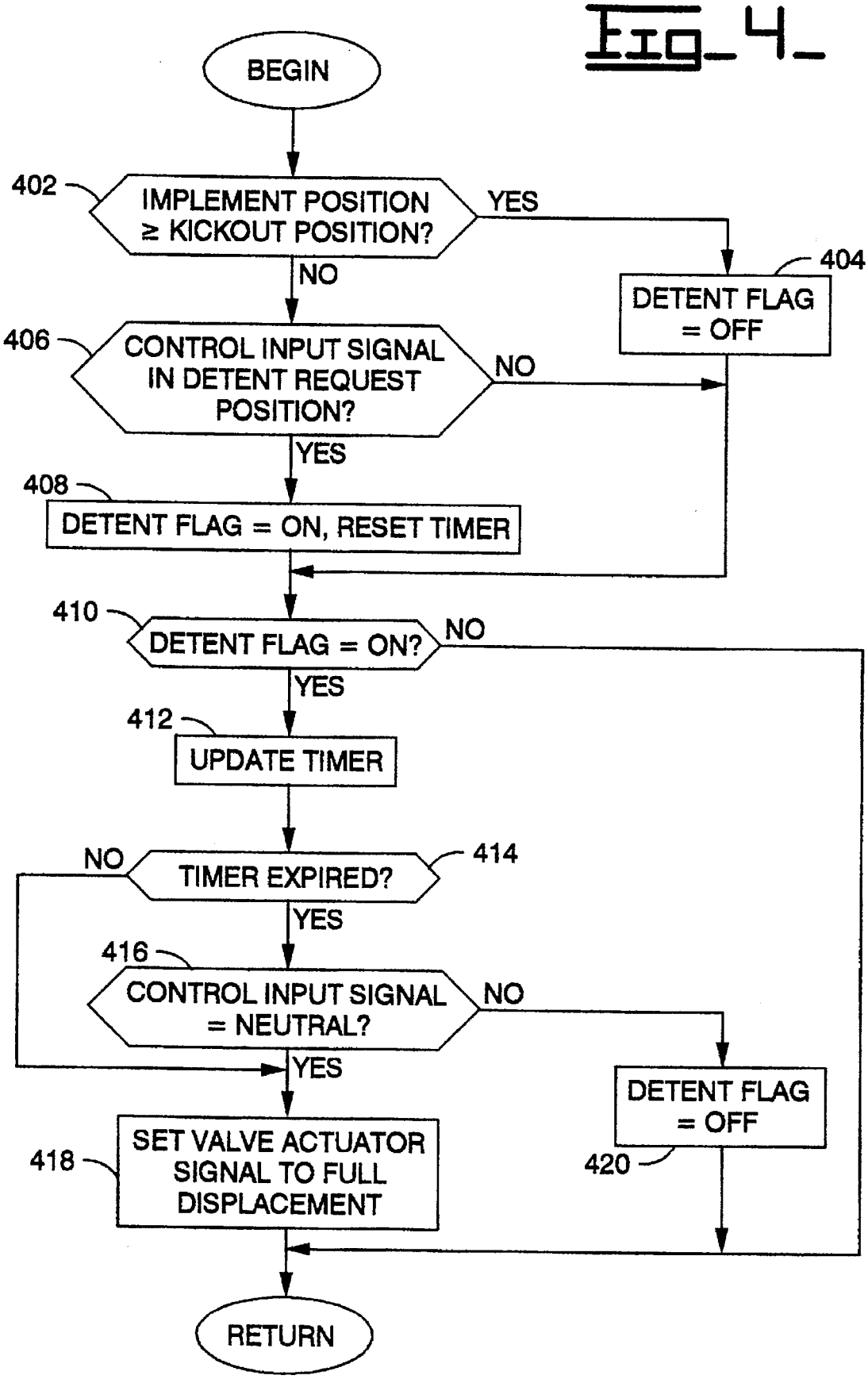

With reference to FIG. 4, the detent algorithm will now be discussed. In a first decision block 402, the implement position signal is compared with a preset on preprogrammed kickout position. If the implement position signal is greater than or equal to the kickout position, then control proceeds to a sixth control block 404. In the sixth control block 404, a detent flag is set to OFF.

If in the first decision block 402 the implement position is not greater than or equal to the kickout position, then control proceeds to a second decision block 406. In the second decision block 406, if the control input signal is in a detent request position, i.e., between the full request position and the full lever travel position, then control proceeds to a seventh control block 408. If the control input signal is not in a detent request position, then control proceeds to a third decision block 410.

In the seventh control block 408, the detent flag is set to ON and a timer is reset. Control then proceeds to the third decision block 410.

In the third decision block 410, if the detent flag is ON then control proceeds to an eighth control block 412. If the detent flag is not ON, then control returns to the main control algorithm of FIG. 3. In the eighth control block 412, the timer is updated.

In a fourth decision block 414, if the timer has expired, i.e., a preset time has passed since the timer was reset, then control proceeds to a fifth decision block 416. If the timer has not expired, then control proceeds to a ninth control block 418.

In the fifth decision block 416, if the control input signal is equal to NEUTRAL, then control proceeds to the ninth control block 418. In the ninth control block 418, the valve actuator signal is set to full displacement. Control then returns to the main control routine.

If in the fifth decision block 416 the control input signal is not equal to NEUTRAL, then control proceeds to a tenth control block 420. In the tenth control block 420, the detent flag is set to OFF.

INDUSTRIAL APPLICABILITY

With reference to the drawings and in operation, the present invention provides an apparatus 102 and a method for providing a detent function for a hydraulic implement 106. For example, on a bucket loader, a single electronic control handle controls raising and lowering of the hydraulic implement or boom linkage. The apparatus 102 may provide a detent function for raising and a detent for lowering the hydraulic implement.

In order to raise the bucket, the operator would move the control handle from the NEUTRAL position toward a full lever travel position in one direction. Between the neutral position and a full request position, valve displacement is controlled via a computer lookup table.

In order to activate the detent position, the operator must move the electronic control handle 108 into a detent request area, i.e. between the full request position and the full lever travel position. To activate the detent function, the operator moves the electronic control handle into the detent request area and then releases the electronic control handle 108.

Once the detent function is activated, the electronic control means 110 sets the valve actuation signal to full displacement until either: the hydraulic implement reaches the detent desired position or the operator moves the handle 108 out of the neutral position.

If the operator moves the lever 108 into the detent request area and holds it there, the detent function is not activated.

The operator must move the electronic control handle 108 into the detent request area and release it. Thus, if the electronic control handle 108 is in the detent request area, the detent function is activated only if after a preset time period (indicated by the timer) the electronic control handle is in the neutral position.

This structure allows the operator to manually interrupt the detent function in two ways:

(1) moving the control handle out of its neutral position once the detent function is activated, or, (2) not fully returning the control handle to its neutral position once the detent function is activated.

Other aspects, objects, and features of the present invention can be obtained from a study of the drawings, disclosure, and the appended claims.

I claim:

1. An apparatus for providing a detent function on a hydraulic system, the hydraulic system including a hydraulic implement movable between first and second implement positions, comprising:

control input means, operable by an operator between first and second control positions, for producing a control input signal indicative of desired movement of the hydraulic implement between the first and second implement positions;

electronic control means, coupled to said control input means, for receiving said control input signal and responsively producing a valve actuation signal;

hydraulic control means, coupled between said electronic control means and the hydraulic implement, for receiving the valve actuation signal and responsively providing hydraulic fluid flow to the hydraulic implement;

wherein said electronic control means includes:

means for monitoring said control input signal and responsively producing an active detent signal if said control input signal follows a preset pattern; and means for receiving said active detent signal and automatically providing a detent function by actuating said hydraulic control means at full displacement in response to receiving said active detent signal.

2. An apparatus, as set forth in claim 1, wherein said preset pattern is followed if said control input signal is equal to a first preset value and subsequently equal to a second preset value within a predetermined time period.

3. An apparatus, as set forth in claim 1, wherein said control input means includes an electronic control handle movable from a NEUTRAL position to a first control position and from said first control position to a second control position, the area from said first control position to said second control position defining a detent request area.

4. An apparatus, as set forth in claim 3, wherein said preset pattern is defined as movement by said operator of said electronic control handle from said NEUTRAL position to said detent request area and subsequent release of said electronic control handle back to said NEUTRAL position.

5. An apparatus, as set forth in claim 4, wherein said electronic control means includes means for terminating said detent function if one of the following occur:

the hydraulic implement reaches a pre-set position, and said operator moves said electronic control handle.

6. An apparatus, as set forth in claim 4, including force feedback means for providing feedback to said operator through said control input means, said feedback to said operator is defined as a force applied to said electronic control handle in a direction opposite to movement of said electronic control handle by said operator, said force being proportional to the distance of the electronic control handle from a NEUTRAL position.

7. An apparatus, as set forth in claim 6, wherein the force applied to the electronic control lever between said NEUTRAL position and said first control position is linear with a first preset slope and the force applied to the electronic control lever between said first control position and said second control position being linear with a second preset slope.

8. An apparatus, as set forth in claim 7, wherein said force applied to said electronic handle (108) between said first and second control positions being greater than the force applied between said NEUTRAL position and first control position.

9. An apparatus, as set forth in claim 8, wherein said second preset slope is greater than said first preset slope.

10. An apparatus, as set forth in claim 1, including force feedback means for providing feedback to said operator through said control input means.

11. An apparatus, as set forth in claim 10, wherein said control input means includes an electronic control handle and said feedback to said operator is defined as a force applied to said electronic control handle in a direction opposite to movement of said electronic control handle by said operator.

12. An apparatus, as set forth in claim 11, wherein said force is proportional to the distance of the electronic control handle from a NEUTRAL position.

13. An apparatus for providing a detent function on a hydraulic system, the hydraulic system including a hydraulic implement movable between first and second implement positions, comprising:

an electronic control handle, operable by an operator between first and second control positions, for producing a control input signal indicative of desired movement of the hydraulic implement between the first and second implement positions;

electronic control means, coupled to said electronic control handle, for receiving said control input signal and responsively producing a valve actuation signal;

hydraulic control means, coupled between said electronic control means and the hydraulic implement, for receiving the valve actuation signal and responsively providing hydraulic fluid flow to the hydraulic implement;

wherein said electronic control means including means for monitoring said control input signal and responsively providing a detent function if said operator moves said electronic control handle into a detent request area and releases said electronic control handle within a predetermined time period.

14. An apparatus, as set forth in claim 13, wherein said means for providing a detent function includes means for actuating said hydraulic control means at full displacement until one of the following occur:

the hydraulic implement reaches a detent position, and said operator moves said electronic control handle.

15. An apparatus for providing a detent function on a hydraulic system, the hydraulic system including a hydraulic implement movable between first and second implement positions, comprising:

an electronic control handle, operable by an operator between first and second control positions, for producing a control input signal indicative of desired movement of the hydraulic implement between the first and second implement positions;

electronic control means, coupled to said control input means, for receiving said control input signal, providing a detent function, and responsively producing a valve actuation signal;

hydraulic control means, coupled between said electronic control means and the hydraulic implement, for receiving the valve actuation signal and responsively providing hydraulic fluid flow to the hydraulic implement; and, force feedback means for providing feedback to said operator through said control input means, said feedback to said operator is defined as a force applied to said electronic control handle in a direction opposite to movement of said electronic control handle by said operator, said force being proportional to the distance of the electronic control handle from a NEUTRAL position; wherein the force applied to the electronic control lever between said NEUTRAL position and said first control position is linear with a first preset slope and the force applied to the electronic control lever between said first control position and said second control position being linear with a second preset slope;

wherein said force applied to said electronic handle between said first and second control positions being greater than the force applied between said NEUTRAL position and first control position; and, wherein said second preset slope is greater than said first preset slope.

16. A method for providing a detent function on a hydraulic system, the hydraulic system including a hydraulic implement movable between first and second positions, including:

receiving a control input signal generated by a control handle in response to operator input;

monitoring said control input signal;

activating a detent function if said control input signal follows a preset pattern; and, wherein said preset pattern is followed if said input control signal is equal to a first predetermined value and subsequently equal to a second predetermined value within a predetermined period of time.

* * * * *